US007604845B2

(12) United States Patent
Takeuchi et al.

(10) Patent No.: US 7,604,845 B2
(45) Date of Patent: Oct. 20, 2009

(54) METHOD FOR COATING INTERNAL MEMBER HAVING HOLES IN VACUUM PROCESSING APPARATUS AND THE INTERNAL MEMBER HAVING HOLES COATED BY USING THE COATING METHOD

(75) Inventors: Jun Takeuchi, Toyonaka (JP); Masaaki Kishida, Itami (JP); Tadakazu Matsunaga, Takarazuka (JP); Shosuke Endoh, Nirasaki (JP)

(73) Assignee: Tokyo Electron Limited, Tokyo (JP)

( * ) Notice: Subject to any disclaimer, the term of this patent is extended or adjusted under 35 U.S.C. 154(b) by 976 days.

(21) Appl. No.: 10/663,793

(22) Filed: Sep. 17, 2003

(65) Prior Publication Data

US 2004/0058070 A1 Mar. 25, 2004

(30) Foreign Application Priority Data

Sep. 20, 2002 (JP) ..... 2002-275889

(51) Int. Cl.

| | |
|---|---|
| ***B05D 1/32*** | (2006.01) |
| ***C23C 4/02*** | (2006.01) |
| ***C23C 4/06*** | (2006.01) |
| ***C23C 4/10*** | (2006.01) |

(52) U.S. Cl. ..... 427/448; 427/453; 427/454; 427/446; 427/455

(58) Field of Classification Search ..... 427/448
See application file for complete search history.

(56) References Cited

U.S. PATENT DOCUMENTS

| | | | | |
|---|---|---|---|---|
| 4,115,507 | A * | 9/1978 | Pico et al. | 264/267 |
| 5,634,266 | A * | 6/1997 | Sherstinsky et al. | 29/825 |
| 2003/0007308 | A1 * | 1/2003 | Harada et al. | 361/234 |
| 2003/0154919 | A1 * | 8/2003 | Rice et al. | 118/504 |

FOREIGN PATENT DOCUMENTS

| | | |
|---|---|---|
| JP | 05-278038 | * 10/1993 |
| JP | 7-335732 | 12/1995 |
| JP | 01/54188 | * 7/2001 |

OTHER PUBLICATIONS

Mar. 2008 translation of Japan 05-278038, which was published Oct. 26, 1993.*
Mar. 2008 translation of WO 01/054188, which was published Jul. 26, 2001.*

* cited by examiner

*Primary Examiner*—Katherine A Bareford
(74) *Attorney, Agent, or Firm*—Smith, Gambrell & Russell, LLP

(57) ABSTRACT

A method of forming a coating film of ceramic material on a surface of an internal member disposed in a vacuum processing apparatus, the surface of the internal member having holes formed therein. The method involves: (A) filling the holes of the internal member with padding plugs, each of which has a core member made from a metal material and a metal-resin composite layer covering the circumferential surface of the core member, the metal-resin composite layer being a complex composed of a metal material and a resinous material exhibiting nonconjugative property to a coating film; (B) forming a ceramic coating film on the surface of the internal member by plasma spraying after step (A); and (C) extracting the padding plugs out of the holes after step (B).

4 Claims, 3 Drawing Sheets

METHOD FOR COATING INTERNAL MEMBER HAVING HOLES IN VACUUM PROCESSING APPARATUS AND THE INTERNAL MEMBER HAVING HOLES COATED BY USING THE COATING METHOD

BACKGROUND OF THE INVENTION

1. Technical Field of the Invention

The present invention relates to a coating method for coating an internal member having holes in a vacuum processing apparatus and the internal member having holes coated by the coating method. In detail, the present invention relates to a method for forming a ceramic coating membrane on a internal member having its surface with small holes (pores) in a vacuum processing apparatus used for producing semiconductor wafers, in order to improve the durability of the member. As the internal member having holes, for example, there is an electrostatic chuck having a suction surface for holding a semiconductor wafer. Accordingly, the present invention also relates to the electrostatic chuck coated by the above coating method.

2. Description of the Related Art

When applying CVD process, sputtering, etching, etc. on a semiconductor wafer, an electrostatic chuck has been widely used to hold the semiconductor wafer in view of effecting the designated processing appropriately.

Basically, the electrostatic chuck has a structure where an electrode of conductive material is embedded. In operation, when a high-voltage direct current (DC) voltage is applied to an electrode layer, an electrostatic absorbing force is generated on a suction surface of an insulating body of the electrostatic chuck.

However, if the suction surface of the insulating body is worn by the semiconductor wafer or if sputtering material of the sputtering process collides with the suction surface, there may arise problems that the suction surface is damaged in its insulation performance and the durability of the insulating body is deteriorated.

In order to solve the problems, there is known a technique as follows.

For example, Japanese Patent Publication (kokai) No. 7-335732 discloses a method of forming a coating film of ceramic material, such as $Al_2O_3$, on the suction surface of an electrostatic chuck by means of plasma spraying. This coating film serves to protect a member having the film formed thereon. Note, the insulating body itself may be formed by a coating film of ceramic material.

Additionally, it is also known that when applying a variety of above-mentioned treatments (processings) to a semiconductor wafer absorbed by an electrostatic chuck, the temperature of the semiconductor wafer has a great influence on the quality of the processed wafer. Therefore, Japanese Patent Publication (kokai) No. 7-335732 further proposes a technique to blow temperature-regulated He-gas against the suction surface of an electrostatic chuck in order to control the temperature of a semiconductor wafer to be absorbed by the chuck. In this case, the electrostatic chuck is provided, on the suction surface, with gas injection holes.

In order to form the above-mentioned coating film on the electrostatic chuck having the gas injection holes in the suction surface, it is required for a coating material so as not to enter the gas injection holes. Nevertheless, there is no industrial method which is effective to this the requirement up to this day.

For example, there may be expected a method of applying adhesive tapes to the gas injection holes in the suction surface.

In accordance with this method, however, since each adhesive tape conceals even the suction surface (portion) around the gas injection hole, a zone having no coating film is produced in the circumference of each gas injection hole.

Alternatively, it is also supposed to insert padding plugs of fluoropolymer having low adherability to the coating film into the gas injection holes, respectively. However, since each of the padding plugs has a small diameter, the resinous pudding plugs may be molten due to heat of plasma spraying during the coating process thereby causing their inferior closing of the gas injection holes or causing the molten resinous material to drop into the gas injection holes for fixation.

It is noted that the gas injection holes are communicated, on the backside of the above-mentioned insulator, with a gas supply passage built in an electrostatic chucking unit. It is extremely difficult to remove the resinous material of each padding plug, which has dropped into the gas supply passage through the gas injection hole and which is firmly fixed in the gas supply passage. Providing that even trace amounts of resin is remained, when applying a CVD process etc. to a semiconductor wafer while using an electrostatic chuck, the residual resin will be vaporized to influence the quality of the processed wafer.

If the padding plugs are made of a metal material, they are not molten by heat of plasma spraying. However, it is noted that coating material conjugates to the metal material of the padding plugs disadvantageously. Even if it is desired to extract the padding plugs after the coating process, they could not be extracted with ease since they are welded to the coating film. High-handed extraction would cause the coating film to be peeled or cracked.

Meanwhile, there is a case that the coating film has already contained microscopic cracks before extracting the padding plugs from the gas injection holes. As for the reason of the microscopic cracks, we assume that a difference in thermal deformation between the padding plugs and the coating film, both of which have been subjected to thermal expansion due to the heat of plasma spraying and the sequent cooling, produces an excessive thermal stress therebetween to make the coating film contain the above defects, such as cracks. It is also noted that the more strongly the padding plugs are welded to the coating film, the larger the above thermal stress grows.

The above-mentioned problem arises in not only the electrostatic chuck but a internal member having holes which is disposed in each processing chamber of all kinds of vacuum processing apparatuses and which has small holes formed in the member's surface to be covered with a coating film.

SUMMARY OF THE INVENTION

Taking the above situation into consideration, an object of the present invention is to provide a coating method for coating a internal member having holes, such as electrostatic chuck, in a vacuum processing apparatus, the coating method enabling solving the above-mentioned problems about the technique of filling the small holes (pores) with the pudding plugs, thereby allowing a coating film superior in its quality performance to be produced effectively. Additionally, another object of the present invention is to provide a internal member having holes manufactured by the present coating method.

According to a first aspect of the invention there is provided a coating method for forming a coating film of ceramic material on a surface of a internal member disposed in a vacuum processing apparatus, the internal member having holes formed on the surface, the method comprising: a step (A) of filling the holes of the internal member with padding plugs each of which has a core member made from a metal material and a metal-resin composite layer covering the circumferential surface of the core member, the metal-resin composite layer being a complex consisting of a metal material and a resinous material exhibiting nonconjugative property to the coating film; a step (B) of forming a ceramic coating film on the surface of the internal member by means of plasma spraying after the step (A); and a step (C) of extracting the padding plugs out of the holes of the internal member after the step (B).

According to a second aspect of the invention in the above coating method, the surface of the internal member having holes is composed of a material selected from a group of aluminum and aluminum base alloys; each of the holes has an inner diameter ranging from 0.3 mm to 5.0 mm; the core member of the padding plug is formed by a steel wire; the metal-resin composite layer of the padding plug is composed of an electroless nickel plating layer ranging from 10 to 50 μm in thickness and having fluoropolymer particles dispersed therein; the coating film is composed of a material selected from a group of $Al_2O_3$, AlN, $TiO_2$ and $Y_2O_3$; and at the step (A), the padding plugs are fitted in the holes so as to project from the surface of the internal member by 1 mm to 3 mm.

According to a third aspect of the invention, there is also provided a coating method for forming a first coating film providing an insulating layer and a second coating film providing an electrode layer embedded in the insulating layer on a base part of an electrostatic chuck as a internal member disposed in a vacuum processing apparatus and having gas injection holes formed on the surface thereof, the method comprising: a step (D) of forming a first insulating layer composed of a coating film of $Al_2O_3$ on the surface of the base part of the electrostatic chuck by using the first aspect of the coating method as described above; a step (E) including: a series of: a process (a) of filling the gas injection holes of the base part with padding plugs made of a metal material; a process (b) of forming a tungsten coating film on the surface of the first insulating layer by means of plasma spraying after the process (a); and a process (c) of extracting the padding plugs out of the gas injection holes of the base part of the electrostatic chuck after the process (b); and forming the electrode layer arranged on the first insulating layer; and a step (F) of forming a second insulating layer composed of a coating film of $Al_2O_3$ on the surface of the electrode layer by using the first aspect of the coating method as described above.

According to a fourth aspect of the invention, in the above third aspect of the coating method, the surface of the internal member having holes is composed of a material selected from a group of aluminum and aluminum base alloys; each of the holes has an inner diameter ranging from 0.3 mm to 5.0 mm; the core member of the padding plug is formed by a steel wire; the metal-resin composite layer of the padding plug is composed of an electroless nickel plating layer ranging from 10 to 50 μm in thickness and having fluoropolymer particles dispersed therein; the coating film is composed of a material selected from a group of $Al_2O_3$, AlN, $TiO_2$ and $Y_2O_3$; and at the step (A), the padding plugs are fitted in the holes so as to project from the surface of the porous internal member by 1 mm to 3 mm.

According to a fifth aspect of the invention, there is further provided a internal member having holes manufactured by using the first aspect of the coating method as.

According to a sixth aspect of the invention, in the internal member having holes of the fifth aspect of the invention, the surface of the internal member having holes is composed of a material selected from a group of aluminum and aluminum base alloys; each of the holes has an inner diameter ranging from 0.3 mm to 5.0 mm; the core member of the padding plug is formed by a steel wire; the metal-resin composite layer of the padding plug is composed of an electroless nickel plating layer ranging from 10 to 50 μm in thickness and having fluoropolymer particles dispersed therein; the coating film is composed of a material selected from a group of $Al_2O_3$, AlN, $TiO_2$ and $Y_2O_3$; and at the step (A), the padding plugs are fitted in the holes so as to project from the surface of the internal member by 1 mm to 3 mm.

According to a seventh aspect of the invention, there is further provided an electrostatic chuck manufactured by using the third aspect of the coating method as described above.

According to an eight aspect of the invention, in the electrostatic chuck of the seventh aspect of the invention, the surface of the internal member having holes is composed of a material selected from a group of aluminum and aluminum base alloys; each of the holes has an inner diameter ranging from 0.3 mm to 5.0 mm; the core member of the padding plug is formed by a steel wire; the metal-resin composite layer of the padding plug is composed of an electroless nickel plating layer ranging from 10 to 50 μm in thickness and having fluoropolymer particles dispersed therein; the coating film is composed of a material selected from a group of $Al_2O_3$, AlN, $TiO_2$ and $Y_2O_3$; and at the step (A), the padding plugs are fitted in the holes so as to project from the surface of the internal member by 1 mm to 3 mm.

(1) Porous Internal Member in Vacuum Processing Apparatus

The present invention is directed to a vacuum processing apparatus, such as semiconductor-wafer processing apparatus, that applies a designated process (e.g. etching, film depositing) to an objected to be processed while making a processing chamber under a vacuum condition smaller than the atmospheric pressure. Besides a vacuum condition as a result of evacuating air in the narrow sense, the above vacuum condition also represents a situation where either plasma gas or ion gas exists when inert gas is present in a vacuum.

The internal member having holes corresponds to either instrument or component to be arranged in the processing chamber of such a vacuum processing apparatus, particularly, a member having small holes in its surface.

In the internal member having holes, it is general that the material of the surface containing the small holes is one of aluminum, aluminum alloy, steel, stainless and the other metal materials. As occasion demands, an anodizing (alumite) processing may be applied on the surface of aluminum.

To give an actual example of the internal member having holes, there are enumerated here with an electrostatic chuck and a shower head.

[Electrostatic Chuck]

There is no limitation in terms of concrete structure and material on use so long as an electrostatic chuck is provided, on its suction surface to absorb a semiconductor wafer with electrostatic action, with gas injection holes for spouting thermal conductive gas.

The present invention is applicable to an electrostatic mechanism or unit built in a general semiconductor wafer processing apparatus or a transfer apparatus.

To give an example of semiconductor wafer processing apparatus, there is a plasma processing apparatus that can perform CVD processing, sputtering, etching or the like. That is, the invention is applicable to a so-called "dry-process" apparatus.

The semiconductor wafer is a thin plate made of all sorts of semiconductor materials, such as silicon, and also an element forming a substrate for electronic elements. Since the electrostatic absorption is not influenced by the material of an element to be absorbed so much, it is possible to select the material for the semiconductor wafer relatively freely.

As the structure for generating an electrostatic attractive force in the electrostatic chuck, there is a structure equipped with a mechanism where an electrode, such as conductive film, is embedded in an insulator to apply a DC high voltage to the electrode. The electrode and the insulator may be altered in terms of material, shape and structure within the similar range to that of the general electrostatic chuck.

The electrostatic chuck has a suction surface in accordance with both profile and dimensions of a semiconductor wafer to be absorbed electrostatically. For example, for a circular semiconductor wafer, it is preferable that the electrostatic chuck is provided with a suction surface having the similar contour. Generally, the suction surface is shaped to be smooth. In the modification, the suction surface may be provided with irregularities for positioning a semiconductor wafer.

As for the gas injection holes as the small holes, their arrangement and structure may be established appropriately so long as they open at the suction of the electrostatic chuck. The suction surface of the electrostatic chuck may be provided, all over the area in contact with the semiconductor wafer, with a number of gas injection holes at intervals. Depending on the position of the suction surface, the density of the gas injection holes may be altered. Although each of the gas injection holes is generally shaped to have a circular section, it may be modified to be oval or elliptical. The inner diameter of the hole is established within the range from 0.3 to 5.0 mm. The electrostatic chuck may be provided with several kinds of gas injection holes of different inner diameters.

Although the gas injection hole is generally formed straight, it may be in the form of a tapered or stepped hole. The respective insides of the gas injection holes are connected with a gas discharge passage supplied with thermal conductive gas. Extending to the inner wall of the gas discharge passage, the depth of each gas injection hole ranges from 1 to 50 mm.

Corresponding to the arrangement of the gas injection holes, the gas discharge passage is connected with a thermal-conductive gas source while branching, merging or altering the diameter of the gas discharging passage.

There is no limitation in the sort of thermal conductive gas so long as its temperature against a semiconductor wafer can be adjusted. Inert gas, such as He, is used for the thermal conductive gas normally.

[Shower Head]

The above electrostatic chuck is arranged, in the processing chamber, on the side of a lower electrode mounting a semiconductor wafer thereon. While, the shower head is a member that is arranged on the side of an upper electrode to spout a processing gas, such as etching gas, thereby applying a required processing to an object to be processed, for example, semiconductor wafer. The shower head is provided with injection holes for the processing gas.

In the shower head, the similar technical conditions to those about the gas injection holes in the above-mentioned electrostatic chuck are applicable to both material and structure of the surface having the injection holes and both dimension and shape of each injection hole.

(2) Coating Film

For example, the coating film is provided to cover the suction surface of the electrostatic chuck with an insulator for protection. Or again, the coating film may constitute either an insulator or an electrode layer itself. Further, the coating film may serve to protect the surface of the shower head provided with the injection holes. Besides, the coating film may project the surface of the internal member provided with the small holes physically or chemically or may afford a designated function to the same surface.

There is no limitation in terms of material and structure of the coating material so long as it can solve these objects.

For an internal member to be arranged in various kinds of semiconductor wafer processing apparatuses, materials tolerable to these processes are selected for the coating film.

As the characteristic features suitable to the coating film, there are listed mechanical strength, durability, abrasion resistance, non-reactivity, corrosion resistance, heat resistance, etc. For example, it is preferable that the selected material does not damage the electrostatic absorbing function of an electrostatic chuck covered with the coating material.

As the materials for the coating film having the above function, there are recommended $Al_2O_3$, AlN, $TiO_2$ and $Y_2O_3$. A plurality of coating films of different materials may be laminated each other. Alternatively, a plurality of materials may be mixed together for one coating film.

The coating film may be established within the range from 50 to 1000 μm in thickness although the thickness differs from one object to another.

The coating film of ceramic material may be impregnated with silicon resinous liquid to seal pores in the coating film. Or again, the surface of the coating film may be ground for finish.

(3) Padding Plugs

The padding plugs are provided to fill the small holes in the internal member in view of preventing the spray material at the coating process by plasma spraying from invading or sticking to the small holes.

Each of the plugs is provided, at least in a position corresponding to the opening of each small hole, with a contour corresponding to the inner profile of the small hole. Concretely, in accordance with the sectional shape of the small hole, the padding plug is formed to have a circular or oval section. Except a plug's portion corresponding to the opening of the small hole, for example, at the plug's portion to be arranged deep in the small hole, a clearance may be produced between the inner face of the small hole and the periphery of the plug. At a plug's portion to be arranged outside the small hole, the plug may be provided with a contour different from the inner shape of the small hole so long as the contour does not disturb the spraying. If the plug is provided, at its tip to be inserted into the small hole, with a chamfer, rounded part or tapered part, then it becomes possible to insert the plug with ease.

In the plug's portion corresponding to the opening of the small hole, the outer diameter of the plug is established to be substantially equal to the inner diameter of the small hole. Owing to the establishment of the outer diameter, it is possible to fit the padding plug to the small hole smoothly because of little interference therebetween. In this case, when the padding plug is expanded thermally at the plasma spraying process, there is generated a sufficient interference between the padding plug and the small hole.

The padding plug may be formed to have a length allowing it to be fitted to the small hole in order to close it. Preferably, the padding plug has an overall length allowing it to project from the surface of the small hole by 1 to 3 mm when it is closed by the plug. With the overall length within this range, there is no possibility that the padding plug obstructs adhesion of the spray material to the suction surface due to the shadow of the plug and furthermore, the extraction of the plug can be performed with ease.

[Core Member]

The core member is made from a metal material. It is desirable that the metal material has a heat resistance capable of enduring a rise in temperature at the spraying process. The metal material whose coefficient of thermal expansion is sufficiently small in comparison with that of the resinous material, is preferable. Preferably, the metal material has a mechanical strength allowing the plug to be extracted out of the small hole after the spraying process. The material superior to integration with the metal-resin composite layer is preferable.

As concrete materials, there are recommended iron type metals, such as steel, aluminum, copper, nickel, etc. In addition to these metals, either alloy among these metals or allow of the above metal and the other metal material may be adopted.

The outer diameter of the core member may be established so as to accord with the inner diameter of the small hole. Normally, the outer diameter of the core member ranges from 0.5 to 3 mm.

[Metal-Resin Composite Layer]

Consisting of a complex of metal material and nonconjugative resinous material to the coating film, the metal-resin composite layer conceals the outer periphery of the core member. The metal-resin composite layer is a layer where a resinous material in micro-state is retained in a metal matrix and further combined for integration. There is excluded one where metal layer and resinous layer are laminated each other.

Depending on material of the coating film and spray conditions, the resinous material exhibits a different conjugative property to the coating film. The nonconjugative property to the coating film means that the coating film could be separated from the resinous material even if the former was stuck to the latter. As the material having such nonconjugative property, it is general that hard-wettable, low frictional, well slippery and non-sticking material is preferable. In detail, there are recommended fluorocarbon resin (fluoropolymer), silicon resin, polyimide resin, polyamide-imide resin, etc.

As the fluoropolymer, there are recommended polytetrafluoro-ethylene (PTFE), coploymer of tetrafluoroethylene-perfluoro alkylvinyl ether (PFA), coploymer of tetrafluoroethylene-hexafluoro propylene (FEP), polychlorotrifluoroethylene (PCTEE), coplymer of tetrafluoroethylene-ethylene (ETFE), polyvinyliden fluoride (PVDF), polyvinyl fluoride (PVF), coplymer of chlorotrifluoroethylene-ethylene (ECTFE), etc.

By holding the resinous material, the metal material has a function to undertake the mechanical strength of the metal-resin composite layer thereby suppressing its thermal deformation. As the concrete materials, there are recommended simplex metals of Ni, Fe, Cu, Zn, Sn, Al or their alloys. Either alloy among these metals or that of the above metal and the other metal material is also recommended. Metal oxide, such as anodized aluminum (alumite), is usable as well.

The characteristics (e.g. hardness, strength, nonconjugative property of surface, etc.) of the metal-resin composite layer varies in accoradnce with the ratio of metal to resin. The more the metal-resin composite layer includes resin content, the more the nonconjugative property of the surface is improved; nevertheless its hardness, strength and heat resistance are trending downward. In detail, the resin content in the metal-resin composite layer may be established within the range from 10 to 30 wt. % although the above tendency differs from one combination of materials to another.

The metal-resin composite layer may be established within the range from 10 to 50 μm in thickness. If the layer is formed too thin, it will be damaged at the installation to the small hole or at the plasma spraying thereby giving insufficient play to the nonconjugative property against the coating film. Conversely, if the layer is formed too thick, it causes the manufacturing labor and cost to be increased.

The metal-resin composite layer may be formed at least either in the core member's part in contact with the small hole or in the neighborhood of the member's part. Alternatively, of course, the metal-resin composite layer may be formed so as to stretch the full length of the core member.

Regarding the manufacturing method, an ordinary means for forming the metal-resin composite layer is applicable so long as it can provide a metal-resin composite layer with the above-mentioned structure and function as target. In detail, there may be employed metal plating layer having resinous particle dispersed therein, metal layer having holes impregnated with resinous particles, metal layer having holes containing resinous particles enclosed therein, etc.

[Fluoropolymer Particle Diffusion Type Electroless Nickel Plating Layer]

As the metal-resin composite layer, there may be adopted an electroless nickel plating layer in which fluoropolymer particles are dispersed. The layer is known as "Kaniflon" (registered trade mark by Japan Kanigen Co. Ltd.) membrane that can be produced by performing nickel plating in a plating solution where fine fluoropolymer powder having its grain size less than 1 μm is dispersed. The nickel plating may contain phosphorus.

As concrete examples of the Kaniflon membrane, there are recommended one film characterized by Ni of 83-86 wt. % , P of 7.5-9 wt. %, PTFE resin of 6-8.5 wt. % (20-25 vol. %) and density of 6.4-6.8 g/cm$^3$, another film characterized by Ni of 88-90 wt. % , P of 8-9.5 wt. %, PTFE resin of 1.5-3 wt. % (5-10 vol. %) and density of 7.3-7.6 g/cm$^3$.

(4) Attachment of Padding Plugs

The padding plug is fitted in each small hole of the internal member. In detail, it is carried out to push the leading side of the plug into the small hole. In this way, the small holes of the internal member are filled with the padding plugs while they are being supported by the small holes.

If there is an interference between the outer diameter of the padding plug and the inner diameter of the small hole, no clearance is produced between the small hole and the padding plug, so that the fixation of the padding plug becomes strong. In practical, even if there is little interference, the invasion of spray material does not raise a problem so much. If anything, such a mating that an operator's manual labor allows the padding plug to be pushed into the small hole would rather facilitate an operator's attaching operation.

If the padding plug could be pushed into the small hole so that the leading end reaches the bottom of the small hole or the inner wall of a passage connected with the small hole, the workability would be improved. If the pudding plug is fixable, the insertion of the padding plug by the wayside of the small hole will be all right.

In a condition to fill the small hole with the padding plug, it is possible to cut off part or all of the padding plug (part) projecting from the small hole. If the padding plug projects from the small hole long, the same plug disturbs the flowing of spray material, so that the thickness of the coating film is reduced partially in the circumference of the small hole.

However, when removing the padding plug after the coating film has been formed, the padding plug projecting from the hole to a certain extent may be convenient for the removal. Therefore, the length of the padding plug (part) projecting from the top of the small hole surface (i.e. the surface of the coating film) may be established from 1 to 3 mm. Each padding plug may be provided, on its periphery, with a constriction, notch or weakened part that facilitates an operator's removal operation of the projecting part.

If repeating an operation to insert a padding plug in the form of a long wire or rod into the small hole and subsequently cut off the inserted padding plug outside the small hole, then it is possible to fit a plurality of padding plugs (pieces) originating from one padding plug to a plurality of small holes, in sequence.

(5) Coating Method

In the plasma spraying method, ceramic spray material is accelerated by the flow of plasma particles to coat the surface of an object with the accelerated spray material.

As one processing condition at the plasma spraying, generally, there is established a plasma temperature ranging from 1200 to 1500° C. Here, the plasma temperature is defined as a temperature at which plasma jet is radiated on the surface to be sprayed with the spray material. It is noted that the plasma temperature is not an initial temperature at which the plasma jet is radiated from a spray unit. The initial temperature may be higher than the above range of the plasma temperature. The processing time is within the range from 300 to 500 mm/sec per one pass. Under the processing conditions within the above ranges, it becomes possible to avoid falling of the molten pudding plugs and the fixing in the holes.

If the surface of the object to be processed is pre-heated or roughened in advance of the plasma spraying, then it is possible to improve the degree of adhesion of the coating film.

(6) Removal of Padding Plugs

On completion of the spray process in succession with the formation of the coating film, the padding lugs can be removed out of the small holes on the surface of the internal member.

Normally, an operator may take and pluck up the upper part of each padding plug by means of a tool. Since the metal-resin composite layer of the padding plug has a considerably low conjugation to the coating film, the operator can extract the padding plug by a small force.

When removing the padding plugs, it is possible to separate the spray material adhering to the surfaces of the padding plugs from the coating film on the suction surface.

(7) Coating Method of Electrostatic Chuck

For the structure of an electrostatic chuck, there can be applied a method for successively coating an insulating layer and an electrode layer embedded in the insulating layer on the metallic (e.g. aluminum) base part of the electrostatic chuck. In detail, the following method is employed.

Basically, it is carried out to repeat the operating processes of: fitting the padding plugs in the gas injection holes; forming a coating film by the technique of plasma spraying; and removing the pudding plugs out of the gas injection holes.

Step D: forming the first insulating layer of a coating film ($Al_2O_3$) on the surface of the base part. By using the padding plugs each having the above metal-resin composite layers, the coating film of $Al_2O_3$ can be formed appropriately.

Step E: forming the electrode layer of a tungsten coating film on the first insulating layer. By employing the metal material, such as steel, for the padding plugs, the tungsten coating film can be formed appropriately. It is possible to save the manufacturing cost in comparison with the using of the padding plugs each having the metal-resin composite layers.

Step F: forming the second insulating layer of a coating film ($Al_2O_3$) on the electrode layer. Similarly to the first insulating layer, the padding plugs each having the metal-resin composite layers are used.

Additionally, while employing the above-mentioned coating method, it is also possible to manufacture an electrostatic chuck itself.

According to the above-mentioned method, by changing the material of the padding plugs in accordance with the material of a coating film to be formed by plasma spraying, it is possible to accomplish appropriate finished quality against any coating film.

By the above-mentioned coating technique of the invention, it is also possible to produce the insulating layer and the electrode layer in the electrostatic chuck effectively, whereby the electrostatic chuck can be improved in its performance.

DESCRIPTION OF THE PREFERRED EMBODIMENT

Referring to FIGS. 1 to 8, an embodiment of this invention will be described in detail, below.

(1) Semiconductor Wafer Processing Apparatus

Figure 1:
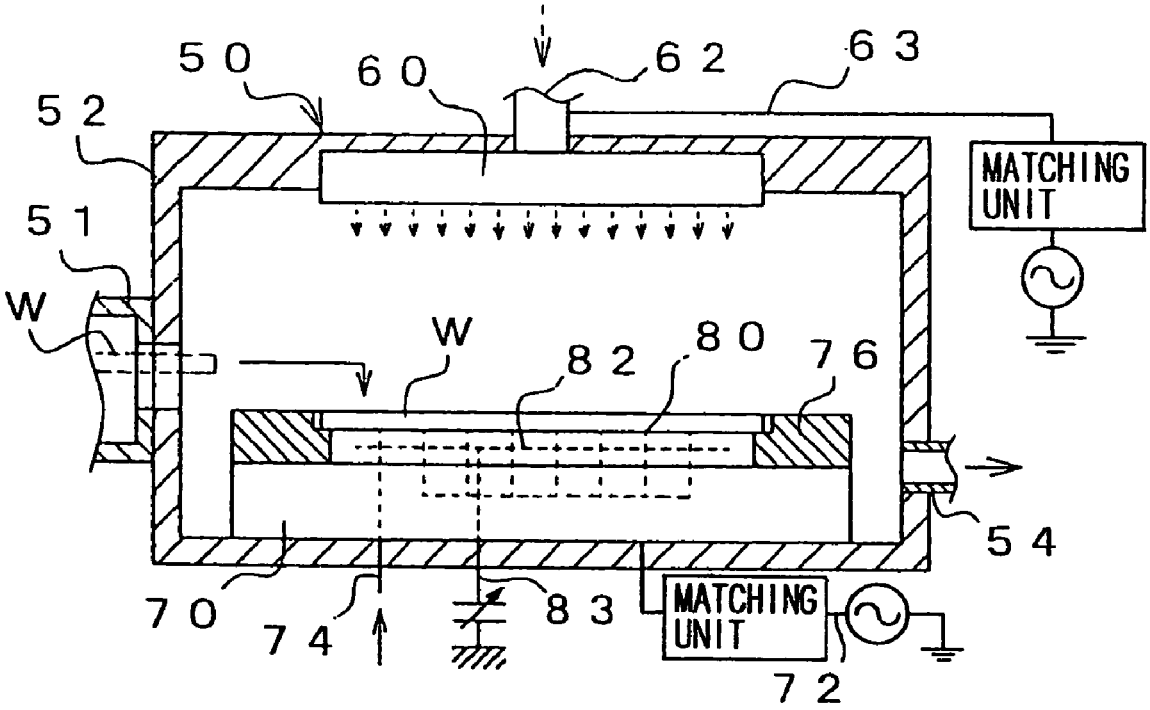
FIG. 1 is an overall structural view of a vacuum processing apparatus in accordance with an embodiment of the present invention.
Figure 2:
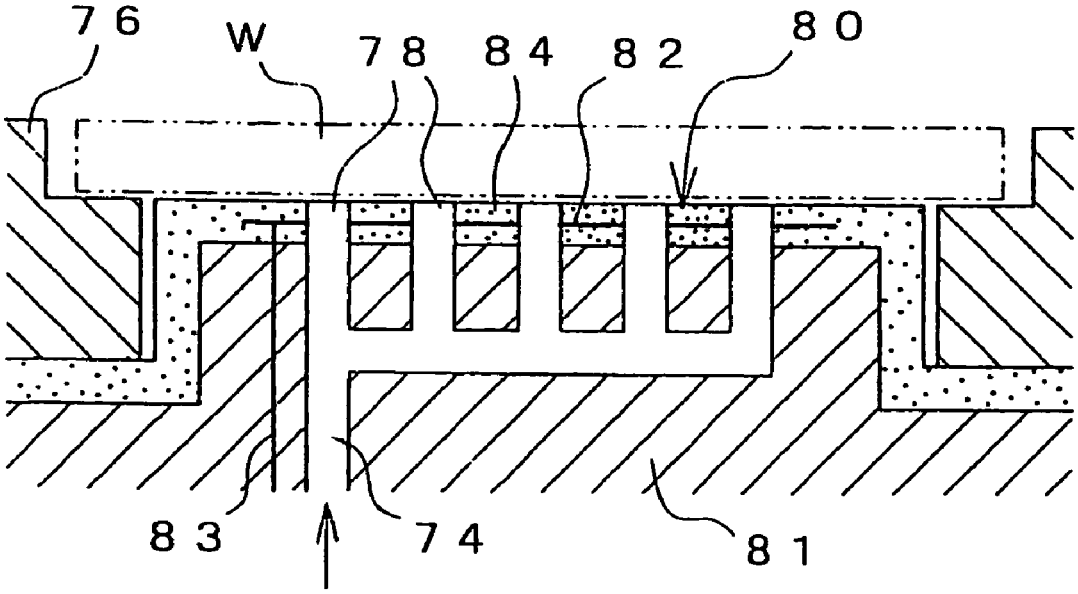
FIG. 2 is an enlarged sectional view of an electrostatic chuck part of the vacuum processing apparatus.
Figure 3:
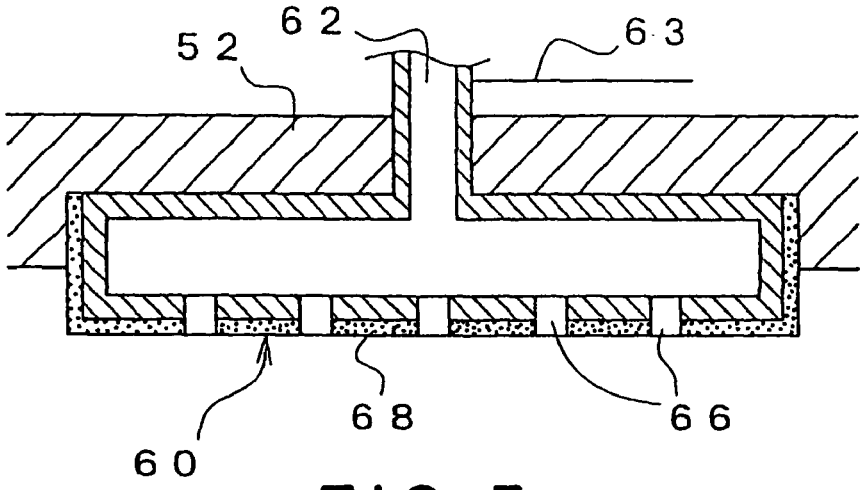
FIG. 3 is an enlarged sectional view of a shower head part of the vacuum processing apparatus.

An embodiment of FIGS. 1 to 3 relates to a plasma processing apparatus for semiconductor wafers, which is equipped with an electrostatic chuck and a shower head.

[Overall Structure]

As shown in FIG. 1, the plasma processing apparatus 50 is provided, in a processing chamber 52, with a mounting part 70 for mounting a semiconductor wafer W thereon to form a lower electrode and the shower head 60 opposed to the part 70 to form an upper electrode. An upper surface of the mounting part 70 forms the electrostatic chuck 80. An interval between the mounting part 70 and the shower head 60 is established to range from 5 to 150 mm.

A high-frequency impress line 63 is connected to the shower head 60. By a high-frequency power source connected to the line 63, a high-frequency power ranging from 13.56 to 100 MHz is impressed to the shower head 60 through an impedance matching unit or the like. Similarly, another -high-frequency impress line 72 is connected to the mounting part 70 to apply a bias high-frequency power of 2 to 13.56 MHz to the part 70.

The processing chamber 52 is exhausted and maintained so as to have a designated vacuum. The processing chamber 52 is communicated with a neighboring preparatory vacuum chamber 51, so that the semiconductor wafer W is transferred between the preparatory vacuum chamber 51 and the processing chamber 52. Although not shown in the figure, the preparatory vacuum chamber 51 is equipped with a transfer arm for transporting the semiconductor wafer W. In operation, the transfer arm extending from the preparatory vacuum chamber 51 into the processing chamber 52 serves to arrange the semiconductor wafer W in a predetermined position of the mounting part 70 and further pick up the wafer W therefrom.

[Detailed Structure of Electrostatic Chuck]

As shown in FIG. 2 in detail, the electrostatic chuck 80 is formed on the top surface of the mounting part 70. An insulating body 84 of a coating film of $Al_2O_3$ is formed on upper and side surfaces of a base part 81 made of a metal material, such as aluminum. Embedded in the upper portion of the insulating body 84 is an electrode layer 82 that comprises a tungsten film. A wire 83 is connected to the electrode layer 82 while penetrating the base part 81 and also extending to the outside. The wire 83 is also connected to a variable voltage source to apply a direct current (DC) high voltage to the electrode layer 82. When the DC high voltage is applied to the electrode layer 82, an electrostatic absorbing force is generated on the surface of the insulating body 84 to absorb the semiconductor wafer W thereon.

The electrostatic chuck 80 is provided, over the whole top surface, with a plurality of gas injection holes 78. These gas injection holes 78 are communicated with a gas passage 74 in the interior of the base part 81. The gas passage 71 is supplied with a heat transfer gas, such as He-gas, for controlling the temperature of the semiconductor wafer W. The heat transfer gas is sprayed against the semiconductor wafer W through the gas injection holes 78. Although not shown in the figure, a coolant passage is formed in the base part 81 for its cooling.

On the mounting part 70 outside the electrostatic chuck 80, a focus ring 76 is arranged so as to surround the periphery of the semiconductor wafer W on the electrostatic chuck 80. The material forming the focus ring 76 depends on the content of processing performed in the processing chamber 52. In detail, for example, if conductive material or insulating material is employed for the focus ring 76, it has a function to confine or diffuse reactive ions.

[Detailed Structure of Shower Head]

As shown in FIG. 3 in detail, a processing-gas supply pipe 62 is connected to the shower head 60 to supply it with a processing gas, such as chlorine gas, in accordance with the processing method. The shower head 60 has a hollow formed therein and a number of injection holes 66 formed on the lower part. The processing gas discharged from the injection holes 66 is plasmized by the application of high-frequency power, thereby applying an etching to a substrate to be processed (i.e. the semiconductor wafer W). In order to effect an appropriate processing on the whole surface of the semiconductor wafer W, both diameters and arrangement of the injection holes 66 are adjusted.

Although not shown in the figure, a diffuser plate is arranged in the inside space of the shower head 60 to diffuse the processing gas.

(2) Coating Process

As for a plasma treatment apparatus for semiconductor wafers having the above-mentioned structure, we now describe a method for forming a coating film forming the insulating body 84 and the electrode layer 82 of the electrostatic chuck 80.

FIGS. 4 to 8 show the process for forming the coating film 80 on the top surface of the mounting part 70 in stages, in the processing apparatus of the above embodiment.

[1st. Insulating Layer]

Figure 4:
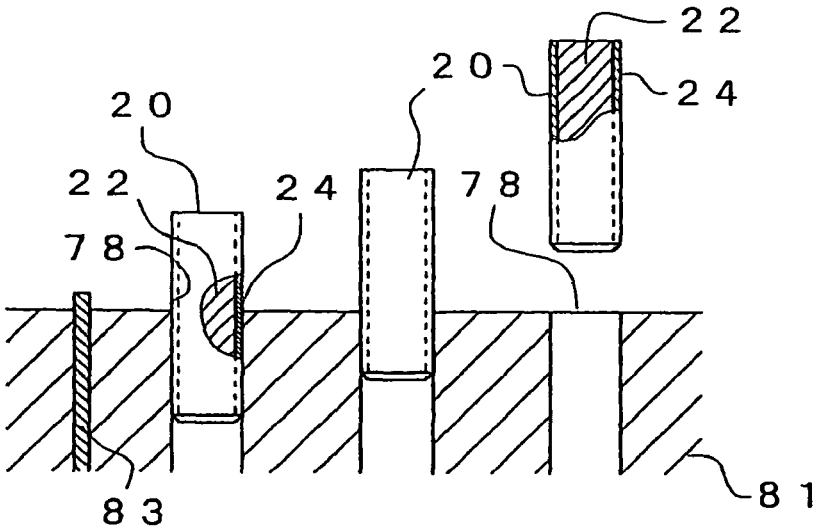
FIG. 4 is a sectional view showing a process for attachment of padding plugs in a coating process.

As shown in FIG. 4, the base part 80 forming the upper part of the mounting part 70 is provided with the gas injection holes 78. Embedded in the base part 81, the wire 83 has its leading end projecting from the upper surface of the base part 81. The wire 83 is made of titanium (conductive material). The whole surface of the wire 83 is coated with $Al_2O_3$ layer (insulating material), thereby being insulated from base part 41.

If the surface roughening is carried out before forming a first insulating layer 84*a* on the top surface of the base part 81, then it becomes possible to improve the junction property between the base part 81 and the first insulating layer 84*a*. Note, during the surface roughening, if the gas injection holes 78 are closed by padding plugs respectively, a processing material does not enter the gas injection holes 78. The padding plugs may be formed by steel wires or the like. These padding plugs will be removed in advance of the plasma spraying.

The padding plugs 20 closing the gas injection holes 78 are fitted to the base part 81 having the surface roughening applied thereon. Each padding plug 20 is formed by a wire member of the same sectional shape as that of the gas injection hole 78. The padding plug 20 includes a core member 22 and a metal-resin composite layer 24 covering the circumferential surface of the member 22. The core member 22 is made from a steel wire. While, the metal-resin composite layer 24 is made from so-called "Kaniflon" (registered trade mark by Japan Kanigen Co. Ltd.) membrane that is an electroless nickel plating film where PTFE resinous particles are dispersed. The leading end of each padding plug 20 is chamfered to facilitate its insertion into the gas injection hole 78.

The padding plugs 20 are fitted to the gas injection holes 78 respectively. In FIG. 4, the right plug 20 illustrates a condition before fitting, while the left plug 20 illustrates a condition after completing the fitting. That is, the padding plugs 20 are arranged so that their upper ends project from the gas injection holes 78 slightly.

Figure 5:
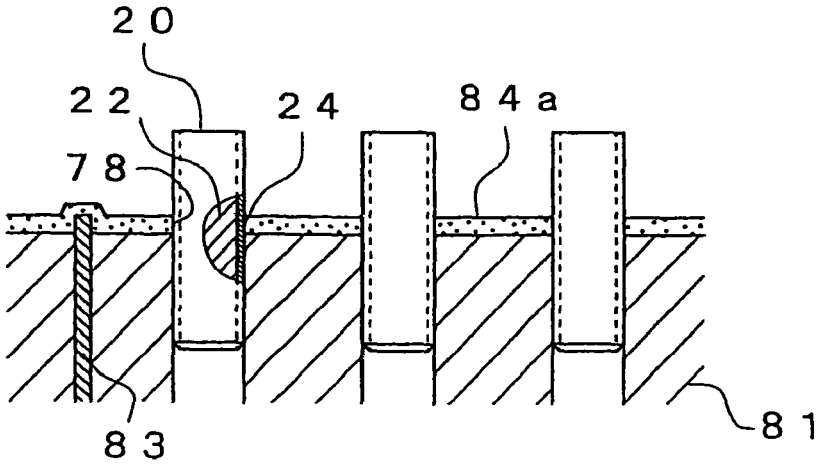
FIG. 5 is a sectional view showing a forming stage of a first insulating layer.

As shown in FIG. 5, the plasma spraying is applied on the surface of the base part 81 having the gas injection holes 78 filled with padding plugs 20 to form a coating film of $Al_2O_3$ of about 500 μm in thickness constituting the first insulating layer 84*a*. The coating film is formed so as to conceal the wiring member 83. In advance of the coating process, the base part 81 is heated up to about 150° C. Consequently, it is possible to prevent an occurrence of defects, such as cracks, in a position where the coating film comes in contact with the wiring member 83.

On condition that the gas injection holes 78 are filled with the padding plugs 20, spray material does not invade the gas injection holes 78. Since each of the padding plugs 20 has sufficient heat resistance with respect to the metallic core member 22 and the metal-resin composite layer 24, there is no possibility that the padding plugs 20 are torn and deformed excessively by heat of plasma flow and spray material. Since the padding plug 20 has a considerably-small difference in coefficient of thermal expansion against the material of the base part 81 and also the coating film 84*a* in comparison with that of a resinous padding plug, there is no possibility that a great thermal stress is generated between the coating film 84*a* and each plug 20 during the plasma spraying process and the sequent cooling process. Therefore, it is possible to prevent the coating film 84*a* from being cracked in the cooling process.

After the coating film 84*a* has been formed on completion of the plasma spray process, the padding plugs 20 are removed. Since the metal-resin composite film 24 exhibiting the slightest conjugative property to the coating film 84*a* is arranged in a contact area between each padding plug 20 and the coating film 84*a*, if only extracting the padding plug 20 upwardly as it is or drawing the plug 20 while twisting it slightly, then the pudding plug 20 can be separated from the coating film 84*a* easily. As a result, it is possible to pull only the plug 20 out of the gas injection hole 78. Thus, it is possible to prevent part of the coating film 84*a* from peeling off together with the plug 20 and also possible to prevent the inner edge of the coating film 84*a* from being cracked.

After the removal of the plugs 20, the coating film 84*a* is ground by about 400 μm to flatten the surface, thereby completing the first insulator layer 84*a*. Simultaneously, the coating film 84*a* covering the wiring member 83 is also sliced off (see FIG. 6). At the tip of the wiring member 83, titanium as a conductive material is exposed to the outside. After grinding, washing and drying processes are applied to the coated base part 81.

[Electrode Layer]

Figure 6:
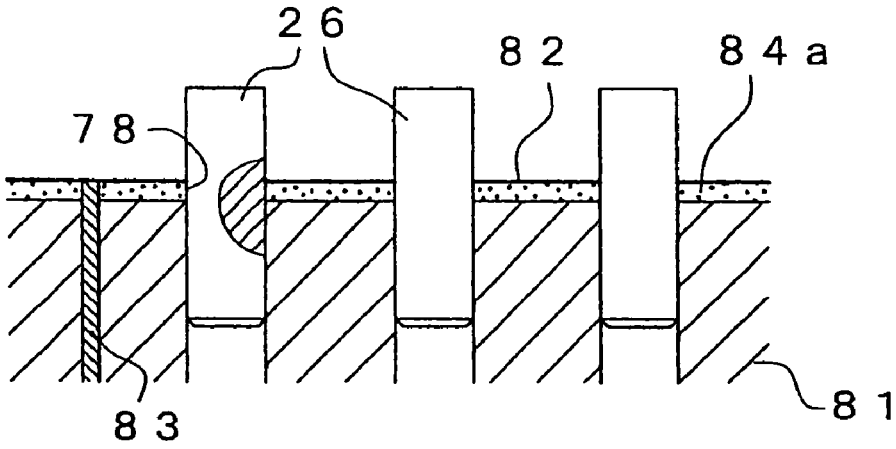
FIG. 6 is a sectional view showing a forming stage of an electrode layer.

As shown in FIG. 6, padding plugs 26 made from steel wires are fitted into the gas injection holes 78. Each of the plugs 26 is made of the same steel material as that of the core member 22 of the above padding plug 20 and the contour of the plug 26 is the same as that of the plug 20.

After fitting the plugs 26, the surface of the first insulator layer 84*a* is roughened. Next, a tungsten coating film of about 50 μm in thickness is formed by the plasma spraying as mentioned above, providing an electrode layer 82. As a result, the top end of the wiring member 83 is joined to the coating layer, realizing an electrical conductive condition.

After the coating film is formed on the whole upper surface of the base part 81, unnecessary part of the coating film is removed by blast finishing, thereby providing the electrode layer 82.

Subsequently, the padding plugs 26 are pulled out. Since the tungsten coating film has nonconjugative property with the steel plugs 26, it is possible to perform the extraction of the plugs 26 with ease.

[2nd. Insulator Layer]

Figure 7:
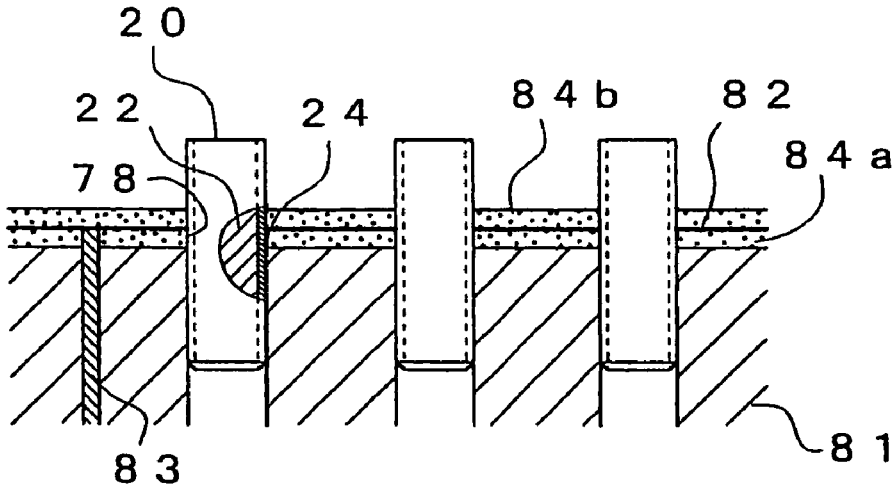
FIG. 7 is a sectional view showing a forming stage of a second insulating layer.

As shown in FIG. 7, the padding plugs 20 similar to the above plugs 26 are fitted in the gas injection holes 78 respectively.

After that, the similar plasma spraying is carried out so as to bury the whole surface of the electrode layer 82 in a second insulator layer 84*b* composed of a coating film of $Al_2O_3$ of about 500 μm. Before the plasma spraying, the base part 81 is heated up to about 100° C.

Consequently, there is provided an electrostatic chuck structure where the tungsten electrode layer 82 is embedded in the insulator 84 having the integrated upper and lower $Al_2O_3$ coating films 84*a*, 84*b*.

Figure 8:
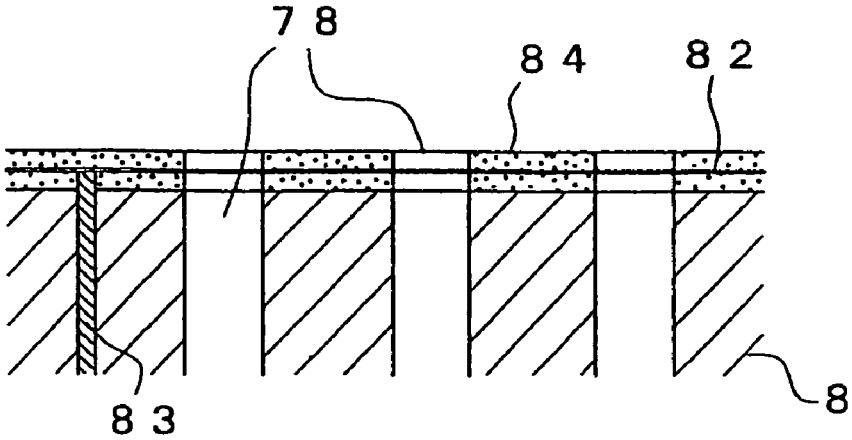
FIG. 8 is a sectional view showing a state after removing the padding plugs.

If only removing the padding plugs as shown in FIG. 8, the basic coating process will be completed.

(3) Post-Treatment Process

After forming these coating films (i.e. the electrode layer 82 and the insulator 84), various post-treatment processes are carried out as occasion demands.

A sealing holes process is effective. In the sealing process, part of the coating films is dipped in silicon resin and further deaerated under a reduced pressure of 55 Torr. in order to fill fine pores existing in the insulator 84 of $Al_2O_3$ with silicon resin. Subsequently, the insulator 84 is heated and baked at 110° C.

It is also effective to grind the surface of the insulator 84 for planarization. The insulator 84 can be finished with 0.1 to 1.6 μm in surface roughness Ra.

After the above finishing process is completed, there can be finally obtained a coating structure that consists of the first insulator layer 84*a* of about 400 μm in thickness, the electrode layer 82 of about 50 μm in thickness and the second insulator layer 84*b* of about 250 μm in thickness.

(4) Lateral Insulator

In the electrostatic chuck 80 of FIG. 2, the coating film 84 is formed so as to extent from the top surface of the base part 81 having the gas injection holes 78 to the lateral surface of the part 81. As for the formation of the coating film 84 on the top surface of the base part 81, the above-mentioned coating method is employed. While, for the coating film 84 from the outer edge about the top surface of the base part 81 to the lateral surface, it is also possible to employ another process different from the above-mentioned coating method.

For example, after roughening the lateral surface of the base part 81, another $Al_2O_3$ coating film similar to the insulator 84 of about 600 μm in thickness can be formed on the lateral surface, allowing it to be covered with the insulator 84. The insulator 84 on the lateral surface of the base part 81 can be subjected to a post-treatment process similar to the above-mentioned post-treatment process for the top surface. Finally, the lateral surface of the base part 81 is covered with the insulator 84 of about 300 to 500 μm in thickness.

More in detail, it is carried out to form the above coating films 82, 84 while masking the lateral surface of the base part 81. Subsequently, the lateral surface is subjected to the coating process while masking the top surface of the part 81.

Because of no presence of the gas injection holes 78, it is possible to apply an ordinary coating process to the lateral surface of the base part 81. It is also possible to use a coating material different from that of the coating films 82, 84. Additionally, it is possible to apply the above-mentioned sealing holes process to the resultant coating film on the lateral surface of the part 81. Of course, silicon resin may be employed as the resinous material for sealant.

If only connecting the coating film on the lateral surface with that on the top surface integrally, then it is possible to establish the insulator 84 that is continuous all over the base part 81.

(5) Concrete Example for Padding Plugs

A steel wire of 1 mm in diameter is coated with "Kaniflon" (registered trade mark) film of about 20 μm in thickness. The Kaniflon film is an electroless nickel plating layer film where PTFE resinous particles are dispersed. The so-obtained wire material having the metal-resin composite layer is cut to pieces of 10 to 15 mm in length each, providing the padding plugs 20.

(6) Plasma Spraying Conditions

As concrete process conditions of the plasma spraying for forming the coating film, there can be employed the following conditions.

Base material: aluminum, Spray material: $Al_2O_3$,

Plasma Temperature: 1200 to 1500° C.,

Plasma Pass Velocity: 300 to 500 mm/sec

Thickness of coating $Al_2O_3$ film: 0.4 to 0.5 mm

After the formation of the coating film, it was cooled to a temperature ranging from 50 to 60° C. and thereafter, the vertical extraction of the padding plugs 20 was carried out by an operator. Consequently, the operator could separate the plugs 20 from the coating film easily without twisting them. There had been no defect, such as peel and crack, in the coating film at all. Thereafter, although the coating film was subjected to a lapping processing for finishing, no defect was found in the so-finished alumina membrane.

It can be estimated that since fluoropolymer particles dispersed in the nickel-phosphorus plating layer did exhibit superior nonconjugative property to $Al_2O_3$ film, the padding plugs 20 could be extracted from the $Al_2O_3$ film smoothly and no defect was produced in the $Al_2O_3$ film.

For comparison, the padding plugs were changed to plugs of chrome-plating steels and the similar coating process was carried out. As a result, it was difficult to pick up the above padding plugs by an operator's vertical extracting only. Therefore, after turning the padding plugs half to full circle to cut adhesive circumferential edges of the plugs, it was carried out to pull them up vertically. Nevertheless, lifting exfoliations arose in the $Al_2O_3$ film in the vicinity of the padding plugs. Even when no exfoliation was produced in extracting the padding plugs, micro-cracks in the $Al_2O_3$ film the were produced in the vicinity of the small holes with the padding plugs by the sequent lapping process.

It is generally said that if a chrome plating layer is buffed, a ceramic spray membrane is difficult to adhere to the buffed surface. However, in case of the thin padding plugs to be fitted in the small-diameter holes, it can be estimated that the chrome plating layer about the small padding plug having a small heat capacity was changed in nature due to heat of the plasma spraying, thereby causing the above adhesion to the $Al_2O_3$ film.

(7) Coating for Shower Head

Basically, if using the similar material to the coating process against the electrostatic chuck, it is possible to accomplish the coating under the similar processing conditions.

For example, the shower head 60 is made of aluminum and its surface is covered with a coating film 86 ($Al_2O_3$) of 300 μm in thickness. In forming the coating film 68, the padding plugs 20 are fitted in the injection holes 66 respectively.

After completing the coating process, the coating film 68 is ground by about 100 μm to flatten the surface of the film 68.

Even when an etching is carried out in the processing chamber 52, it is difficult for by-products of the etching process to adhere to the shower head 60 having the coating film 68 formed thereon. Even if adhering to the shower head 60, it is possible to peel the by-products therefrom with ease.

(8) Effects

According to the coating method for the internal member having holes in the vacuum processing apparatus, since the small holes of the member are filled with the padding plugs each having the metallic core member coated with the metal-resin composite layer in advance of forming the coating film on the internal member by plasma spraying, it is possible to eliminate a bad influence (e.g. damage) of the padding plugs on the coating film, whereby the coating film can be provided with high quality that satisfies the required performance sufficiently.

In detail, there is no possibility that each padding plug is molten due to heat at spraying. Since each padding plug is not welded to the coating film, there is no possibility that the coating film is peeled or cracked in removing the padding plug. As the characteristics in thermal deformation of the pudding plug is close to that of constituents of the coating film and the internal member, an excessive thermal stress is not produced between the padding plug and the coating film in the heating (spraying) process and the subsequent process, it is possible to prevent the coating film from being damaged or cracked due to the thermal stress.

The invention claimed is:

1. A coating method for forming a coating film of ceramic material on a surface of an internal member disposed in a vacuum processing apparatus, the internal member having holes formed on the surface, the method comprising:

a step (A) of filling the holes of the internal member with padding plugs each of which has a core member made from a metal material and a metal-resin composite layer covering the circumferential surface of the core member, the metal-resin composite layer being a complex consisting of a metal material and a resinous material exhibiting nonconjugative property to the coating film;

a step (B) of forming a ceramic coating film on the surface of the internal member by means of plasma spraying after the step (A); and a step (C) of extracting the padding plugs out of the holes of the internal member after the step (B).

2. A coating method according to claim 1, wherein the surface of the internal member having holes is composed of a material selected from a group of aluminum and aluminum base alloys; each of the holes has an inner diameter ranging from 0.3 mm to 5.0 mm; the core member of the padding plug is formed by a steel wire; the metal-resin composite layer of the padding plug is composed of an electroless nickel plating layer ranging from 10 to 50 μm in thickness and having fluoropolymer particles dispersed therein; the coating film is composed of a material selected from a group of $Al_2O_3$, AlN, $TiO_2$ and $Y_2O_3$; and at the step (A), the padding plugs are fitted in the holes so as to project from the surface of the internal member by 1 mm to 3 mm.

3. A coating method for forming a first coating film providing an insulating layer and a second coating film providing an electrode layer embedded in the insulating layer on a base part of an electrostatic chuck as an internal member disposed in a vacuum processing apparatus and having gas injection holes formed on the surface thereof; the method comprising:

a step (D) of forming a first insulating layer composed of a coating film of $Al_2O_3$ on the surface of the base part of the electrostatic chuck by using the coating method as defined in claim 1;

a step (E) including: a series of: a process (a) of filling the gas injection holes of the base part with padding plugs made of a metal material; a process (b) of forming a tungsten coating film on the surface of the first insulating layer by means of plasma spraying after the process (a); and a process (c) of extracting the padding plugs out of the gas injection holes of the base part of the electrostatic chuck after the process (b); and forming the electrode layer arranged on the first insulating layer; and a step (F) of forming a second insulating layer composed of a coating film of $Al_2O_3$ on the surface of the electrode layer by using the coating method as defined in claim 1.

4. A coating method according to claim 3, wherein the surface of the internal member having holes is composed of a material selected from a group of aluminum and aluminum base alloys; each of the holes has an inner diameter ranging from 0.3 mm to 5.0 mm; the core member of the padding plug is formed by a steel wire; the metal-resin composite layer of the padding plug is composed of an electroless nickel plating layer ranging from 10 to 50 μm in thickness and having fluoropolymer particles dispersed therein; the coating film is composed of a material selected from a group of $Al_2O_3$, AlN, $TiO_2$ and $Y_2O_3$; and at the step (A), the padding plugs are fitted in the holes so as to project from the surface of the internal member by 1 mm to 3 mm.

* * * * *